US007845419B2

(12) United States Patent
Naumann

(10) Patent No.: US 7,845,419 B2
(45) Date of Patent: Dec. 7, 2010

(54) SYSTEMS AND METHODS FOR INJECTING OR RETRIEVING TUBEWIRE INTO OR OUT OF COILED TUBING

(75) Inventor: Andre J. Naumann, Calgary (CA)

(73) Assignee: BJ Services Company LLC, Houston, TX (US)

( * ) Notice: Subject to any disclaimer, the term of this patent is extended or adjusted under 35 U.S.C. 154(b) by 114 days.

(21) Appl. No.: 12/256,292

(22) Filed: Oct. 22, 2008

(65) Prior Publication Data

US 2010/0096124 A1 Apr. 22, 2010

(51) Int. Cl.
*E21B 41/00* (2006.01)

(52) U.S. Cl. ..... 166/380; 166/77.2; 254/134.3 FT

(58) Field of Classification Search ..... 166/380, 166/384, 77.2; 254/134.3 FT, 134.3 R, 134.4
See application file for complete search history.

(56) References Cited

U.S. PATENT DOCUMENTS 5,121,872 A * 6/1992 Legget ..... 228/148
5,429,194 A 7/1995 Nice
5,435,395 A 7/1995 Connell
5,503,370 A * 4/1996 Newman et al. .... 254/134.3 FT
5,573,255 A * 11/1996 Salpaka ..... 279/75
5,599,004 A 2/1997 Newman et al.
6,454,014 B2 * 9/2002 Coats et al. ..... 166/384
7,152,685 B2 * 12/2006 Adnan et al. ..... 166/380
2006/0054315 A1 * 3/2006 Newman ..... 166/249

OTHER PUBLICATIONS

British Combined Search and Examination Report dated Jan. 28, 2010, for corresponding British Application No. 0918475.5, filed Oct. 22, 2009.
Julian, J.Y, "State-of-the-Art Coiled Tubing Operations at Prudhoe Bay, Alaska", IPTC 11533, International Petroleum Technology Conference, Dubai, U.A.E., Dec. 4-6, 2007, 10 pgs.
Newman, K.R., "Development of a Coiled Tubing Cable Installation System", II SPE 30679, SPE Annual Technical Conference & Exhibition, Dallas, U.S.A., Oct. 22-25, 1995, pp. 389-395.
Rangel, P.D. "Fiber-Optic-Enabled Coiled-Tubing Operations on Alaska's North Slope", SPE 106567, SPE/ICoTA Coiled Tubing and Well Intervention Conference & Exhibition, The Woodlands, TX, U.S.A., Mar. 20-21, 2007, 8 pgs.

* cited by examiner

*Primary Examiner*—William P Neuder
(74) *Attorney, Agent, or Firm*—Zarian Midgley & Johnson PLLC

(57) ABSTRACT

The present invention provides systems and methods for injecting or retrieving tubewire into or out of coiled tubing. The system comprises an injector, coiled tubing coupled to the injector and a pumping mechanism. The injector is adapted to apply a force to inject or retrieve the tubewire into or out of the coiled tubing while the pump pumps fluid in the direction of the force to provide fluid drag on the tubewire. The tubewire may be bent or straightened, and may include a protuberance on its free end to assist in the injection and retrieval process. During injection, the coiled tubing may remain on a reel or may be stretched out along a surface.

48 Claims, 5 Drawing Sheets

SYSTEMS AND METHODS FOR INJECTING OR RETRIEVING TUBEWIRE INTO OR OUT OF COILED TUBING

BACKGROUND OF THE INVENTION

1. Field of the Invention

The present invention relates generally to coil tubing injection and retrieval and, specifically, to methods and apparatuses for injecting and retrieving tubewire into or out of coiled tubing.

2. Description of the Related Art

In hydrocarbon wells, it is typically necessary to supply electrical power and signals downhole to control various tools and/or collect data. One way to achieve this is by inserting wireline into a coiled tubing and then running the coiled tubing and wireline into the well to a desired location. In general, wireline is a braided steel cable with several layers of armor having conductors inside. Once the wireline is run downhole, an electric current or signal may be applied to the wireline in order to activate the downhole tool, or the wireline may be used to collect and transmit data downhole.

There are a number of techniques used to insert the wireline into the coiled tubing. In one technique, the coiled tubing is stretched out along a surface, and the wireline is pumped or pulled through the coiled tubing. In another, the coiled tubing is run into a well and the wireline is injected. Lastly, the most commonly used method involves injecting the wireline into coiled tubing wrapped onto a reel using a capstan injector. Here, a capstan drum is housed within a high pressure housing, and the wireline is fed into the housing, wrapped around the drum several times and, then, is fed into the coiled tubing via a flow tube. Fluid, normally water, is pumped through the flow tube and through the coiled tubing until the wireline is injected.

High drag forces are present during the capstan injection technique. The flow tube has a small internal diameter so that when the fluid is pumped through it, high velocity is generated which creates a high drag force on the wireline. This force is used to pull the wireline through the tube and into the coiled tubing. The force also creates tensions on the wireline as it is wrapped around the drum, thus allowing the capstan effect to work. The rotating drum in the capstan injector, plus the capstan multiplier effect, is enough to pull the wireline off the reel and against the high pressure into the capstan injector. The fluid being pumped through the coiled tubing continues to drag the wireline along until it is injected.

There are a number of problems associated with the wireline techniques. First, depending on the fluid pumped, the wireline can be damaged. For example, if acidic fluid is used, the wireline becomes damaged over time. Second, the wireline requires in-field maintenance due to the fact the amount of wireline slack within the coiled tubing needs to be controlled and adjusted over the life of the string, which is an awkward and time consuming procedure. Third, due to the relatively large outside diameter and high roughness of the wireline, there is a significant increase in pumping pressure or loss of pump rates associated with coiled tubing strings containing wireline. Fourth, it is difficult to install wireline into long lengths of coiled tubing due to the high pumping pressures required to do so using the capstan injector, or due to the difficulty in finding a deep well or long unobstructed surface that might otherwise be required. Last, the wireline is not durable in the long run since it is susceptible to kinking and birdnesting if not cared for properly.

There is another product currently available, known as tubewire, which may be used to provide power and data communication downhole. In general, a tubewire consists of a tube containing an insulted wire and may come in various sizes. An example is the tubewire manufactured by Canada Tech Corporation of Calgary, Canada.

Tubewire provides a number of advantages over braided wireline. First and foremost, is the tube completely encases the wire and protects it from fluid and mechanical damage. Second, tubewire is more durable than wireline, in that tubewire is compatible with a larger variety of pumping fluids. Third, tubewire requires minimal maintenance. Fourth, unlike wireline, tubewire has a small diameter and a smooth surface resulting in little increase in pumping pressure or loss of pump rate. Last, long lengths of tubewire can be injected into a reel of coiled tubing and, therefore, a deep well or long level surface is not required.

Wireline capstan injection techniques, however, will not work with tubewire for several reasons. First, the tubewire is quite stiff relative to its diameter and, thus, would be very difficult to bend and hold tight against the capstan drum. Second, large forces would be required to hold the tubewire tight against the drum and the flow tube would not be able to create such forces without generating unmanageable pressures. Last, the flow tube would need to be long and would require a very small clearance between the inner diameter of the flow tube and the outer diameter of the tubewire; however, since the tubewire is stiff, and it will have a residual curvature: these two aspects will result in high friction drag through the flow tube, thereby creating even more unmanageable pressure induced forces. Moreover, injecting the tubewire using the other wireline methods is impractical and expensive.

In view of these disadvantages, there is a need in the art for an improved injection and retrieval method utilizing a tubewire, and being adapted for use while the coiled tubing is on a reel, thereby providing a more cost efficient injection and retrieval method which supplies a more durable downhole electrical/communication means.

SUMMARY OF THE INVENTION

Various embodiments of the present invention provide systems and methods for injecting or retrieving tubewire into or out of coiled tubing. An exemplary embodiment of the present invention comprises an injector having a drive mechanism, coiled tubing coupled to the injector and a pumping mechanism. The driving mechanism of the injector is adapted to apply a pushing or pulling force to the tubewire in order to inject or retrieve the tubewire, respectively. The pumping mechanism is attached to both the whip and core ends of the coiled tubing. During injection, the injector forces the tubewire into the coiled tubing while a pump pumps fluid into the coiled tubing, thereby producing fluid drag on the tubewire in the direction of the applied force. During retrieval, the fluid flow is reversed while the injector pulls the tubewire from the coiled tubing. During injection, the coiled tubing may remain on a reel or may be stretched out along a surface.

An exemplary embodiment of the present invention may further include a control system adapted to regulate injector forces in order to maintain the injector forces at levels which are necessary for injection or retrieval of the tubewire. The injector forces may include the tubewire spool speed, drive mechanism speed, drive mechanism force, fluid velocity or fluid pressure. The system may also include an apparatus to straighten or bend the tubewire to a selected degree. A protuberance may be attached to the free end of the tubewire in order to apply a force on the tubewire in the direction of fluid flow through the coiled tubing. The system also includes a specially designed packoff between the injector and coiled tubing in order to provide a seal around the tubewire as it moves through the packoff, while also allowing a bit of fluid to lubricate the tubewire. The system may also comprise a wand adjacent the whip end of the coiled tubing in order to assist the tubewire's transition into the injector during injection.

An exemplary method of the present invention may include a method for injecting or retrieving tubewire into or out of coiled tubing, the method comprising the steps of inserting the tubewire into an injector having a drive mechanism, the tubewire being received from a spool; feeding a portion of the tubewire into a first end of the coiled tubing using the drive mechanism, the injector being coupled to the first end of the coiled tubing; and injecting the tubewire into the coiled tubing, the injection being accomplished by pumping fluid into the first end of the coiled tubing while forcing the tubewire into the coiled tubing using the drive mechanism.

In yet another exemplary method, the method may further comprise the step of retrieving the tubewire from the coiled tubing, the step of retrieving comprising the steps of pumping fluid into a second end of the coiled tubing such that the tubewire moves off an inner wall of the coiled tubing, thereby producing slack in the tubewire; and continuing to pump the fluid into the second end of the coiled tubing while pulling the tubewire out of the coiled tubing using the drive mechanism.

The foregoing summary is not intended to summarize each potential embodiment or every aspect of the subject matter of the present disclosure. Other objects and features of the invention will become apparent from the following description with reference to the drawings.

Figure 1A:
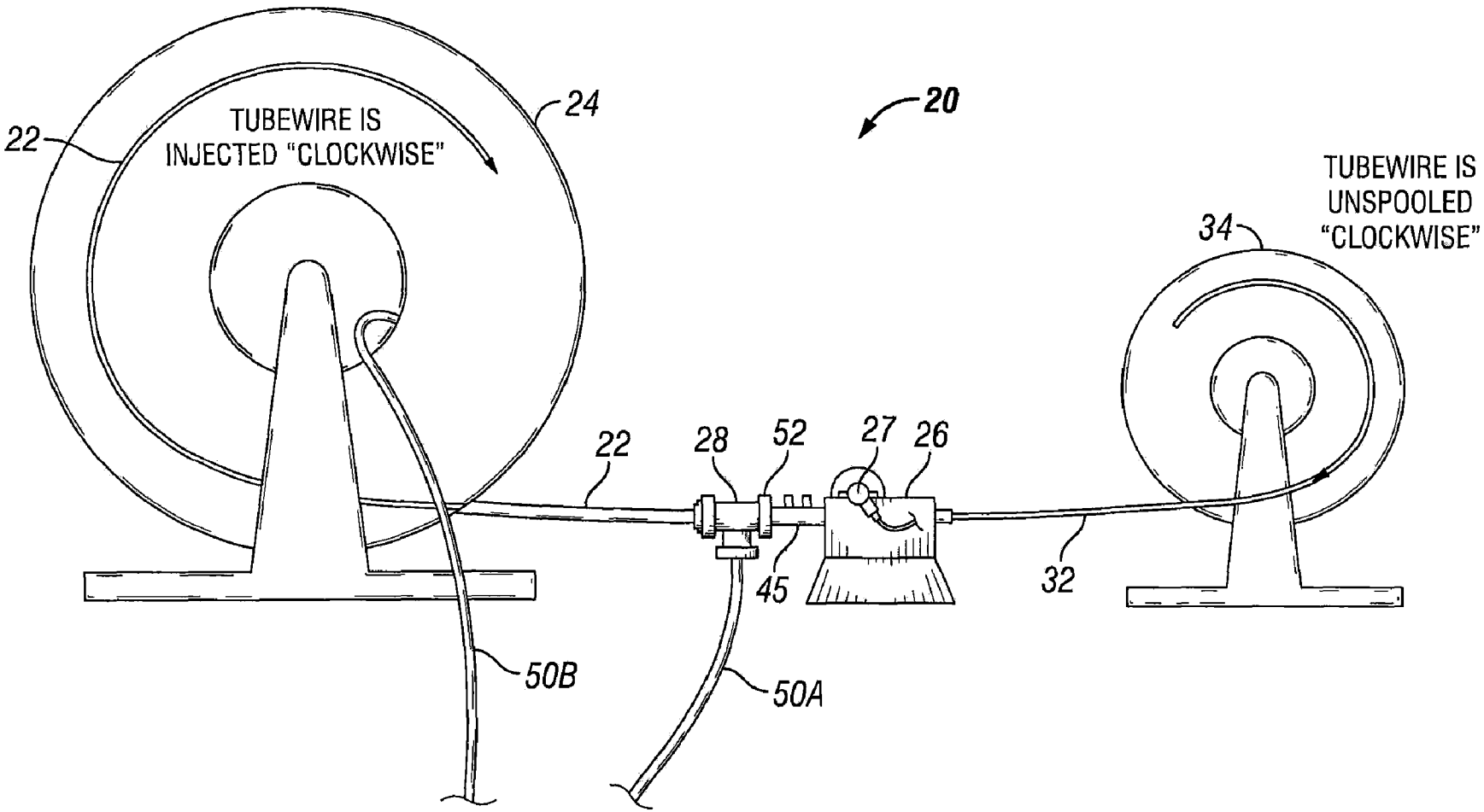
FIG. 1A illustrates a system to inject or retrieve tubewire according to an exemplary embodiment of the present invention.

While the invention is susceptible to various modifications and alternative forms, specific embodiments and methods have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DETAILED DESCRIPTION OF ILLUSTRATIVE EMBODIMENTS

Illustrative embodiments of the invention are described below as they might be employed in systems and methods for injecting or retrieving a tubewire into or out of coiled tubing. In the interest of clarity, not all features of an actual implementation are described in this specification. It will of course be appreciated that in the development of any such system or method, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

In the context of the present disclosure, the term "tubewire" refers to a tube, which may or may not encapsulate a conductor or other communication means, such as, for example, the tubewire manufactured by Canada Tech Corporation of Calgary, Canada. The tubewire, for example, may consist of a ⅛" outer diameter by 0.023" wall of stainless steel or Incoloy 825 tube containing a 16-18 gauge stranded copper wire covered by a Halar™ or Teflon™ insulator. In this example, the insulator is tight against the tube and the wire. In the alternative, the conductor or communication means may encapsulate one or more fiber optic cables. The tubewire may consist of multiple tubes, may be concentric or may be coated on the outside with plastic or rubber. Accordingly, those of ordinary skill in this art having the benefit of this disclosure will realize that a variety of alterations may be made to the tubewire, including, for example, the conductors or communication means may be encapsulated within the tube, the outer diameter, wall thickness, or materials utilized may be varied, the wire or other means may be loose within the tube or the tube may be empty.

Referring to FIG. 1A, an injection and retrieval system 20 is illustrated according to an exemplary embodiment of the present invention. Coiled tubing 22 is wrapped onto a coiled tubing reel or work spool 24. A specialized injector 26 is attached to the whip end of coiled tubing 22 via a T-connection 28, which will be described in more detail later in this disclosure. In this exemplary embodiment, injector 26 is hydraulically driven and controlled, however, it could be electrically driven and controlled or some combination of the two. A pump 30 (FIG. 1B) is connected to the whip end of coiled tubing 22 via T-connection 28 also. Pump 30 pumps fluid at a high velocity through coiled tubing 22, thereby producing fluid drag on the tubewire 32 in order to inject or retrieve it, as will be discussed. Tubewire 32 is wrapped onto another spool 34 and can be fed from spool 34, into injector 26 and into coiled tubing 22. Spool 34 may also be hydraulically or electrically controlled and driven at a selected speed, or by some combination of the two.

Figure 1B:
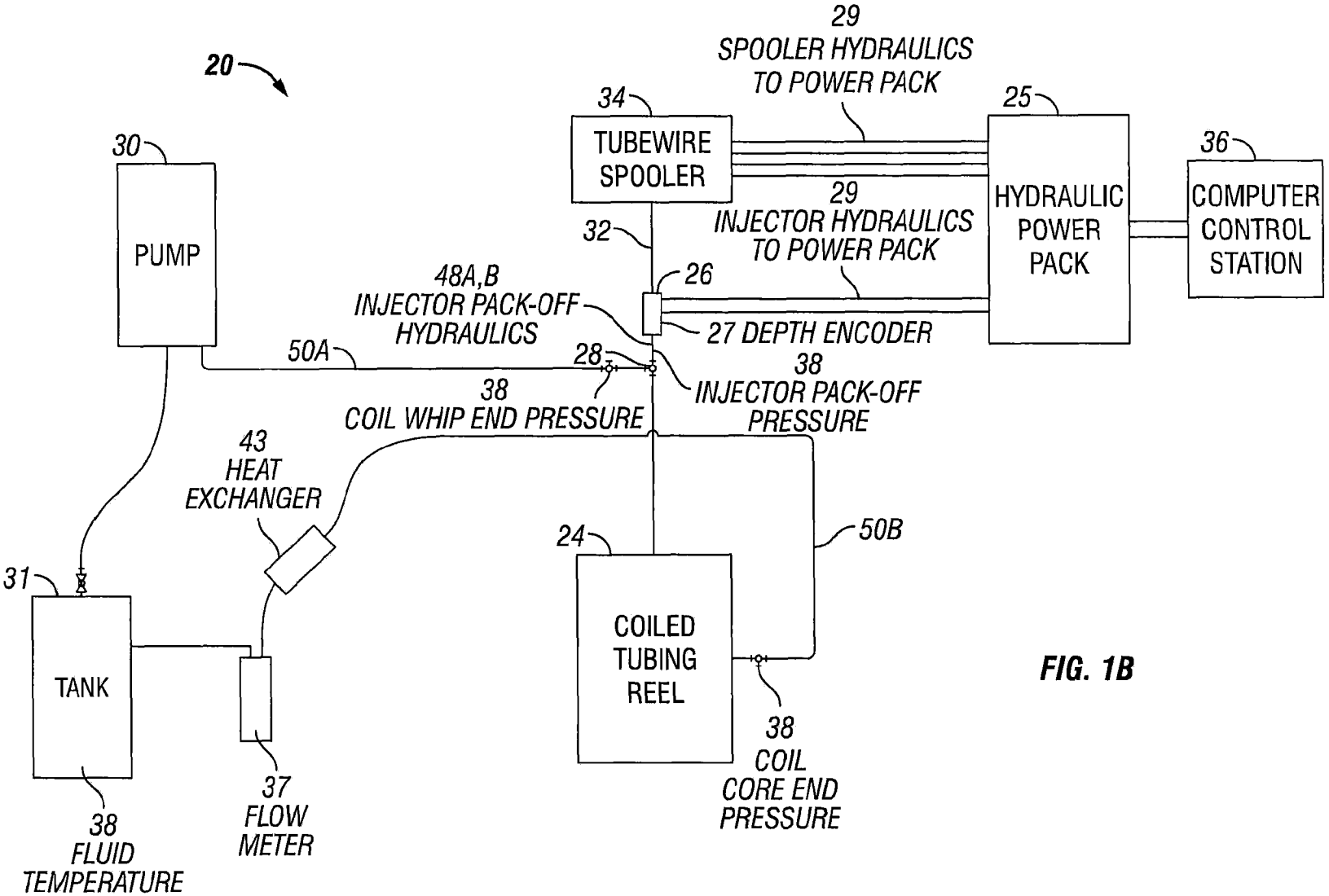
FIG. 1B illustrates a schematic layout of a system to inject or retrieve tubewire according to an exemplary embodiment of the present invention.

FIG. 1B illustrates a schematic layout of injection and retrieval system 20 according to an exemplary embodiment of the present invention. A control system 36 is in communication with spool 34, injector 26, pump 30 and tank 31 via bi-directional communication links 38 in order to monitor and regulate the injector forces on system 20. Control system 36 controls tubewire spooler 34 and injector 26 via a hydraulic power pack 25 coupled to spooler 34 and injector 26 via hydraulic lines 29. The hydraulic power pack 25 comprises valves, as known in the art, for controlling the flow of tubewire 32 to spooler 34 and injector 26 during injection and retrieving processes. Also, there are additional links 38 feeding pressure, depth, velocity and temperature data back to control system 36. Those of ordinary skill in the art having the benefit of this disclosure realize there are a variety of ways in which to construct such a control system.

Bi-directional communication links 38 allow control system 36 to receive and transmit data and may be wired or wireless, as would be readily understood by those ordinarily skilled in this art having the benefit of this disclosure. As will be discussed, the injector forces monitored and regulated by control system 36 can include, for example, the input pressure of coil tubing 22, the speed of spool 34 or the drive mechanism of injector 26, drive mechanism force of injector 26 or the velocity or pressure of the fluid traveling through coiled tubing 22. Control system 36 must monitor the injector forces on system 20 in order to regulate system components to adjust the forces in order to maintain the forces at levels which are necessary for the injection and retrieval of tubewire 32 and to ensure the forces do not damage tubewire 32. Again, those ordinarily skilled in the art having the benefit of this disclosure realize there a number of ways to design and construct such a control system.

Further referring to FIGS. 1A and 1B, pump 30 is coupled to tank 31, whereby fluid is provided to and from the core and whip ends of coiled tubing 22 via treating iron 50*a,b*. Tank 31 may be coupled to a flow meter 37 and a heat exchanger 43, as understood in the art. Please note, however, the layout of system 20 is exemplary in nature only, and those ordinarily skilled in the art having the benefit of this disclosure realized there are a variety of ways in which to design such a system.

Figure 2:
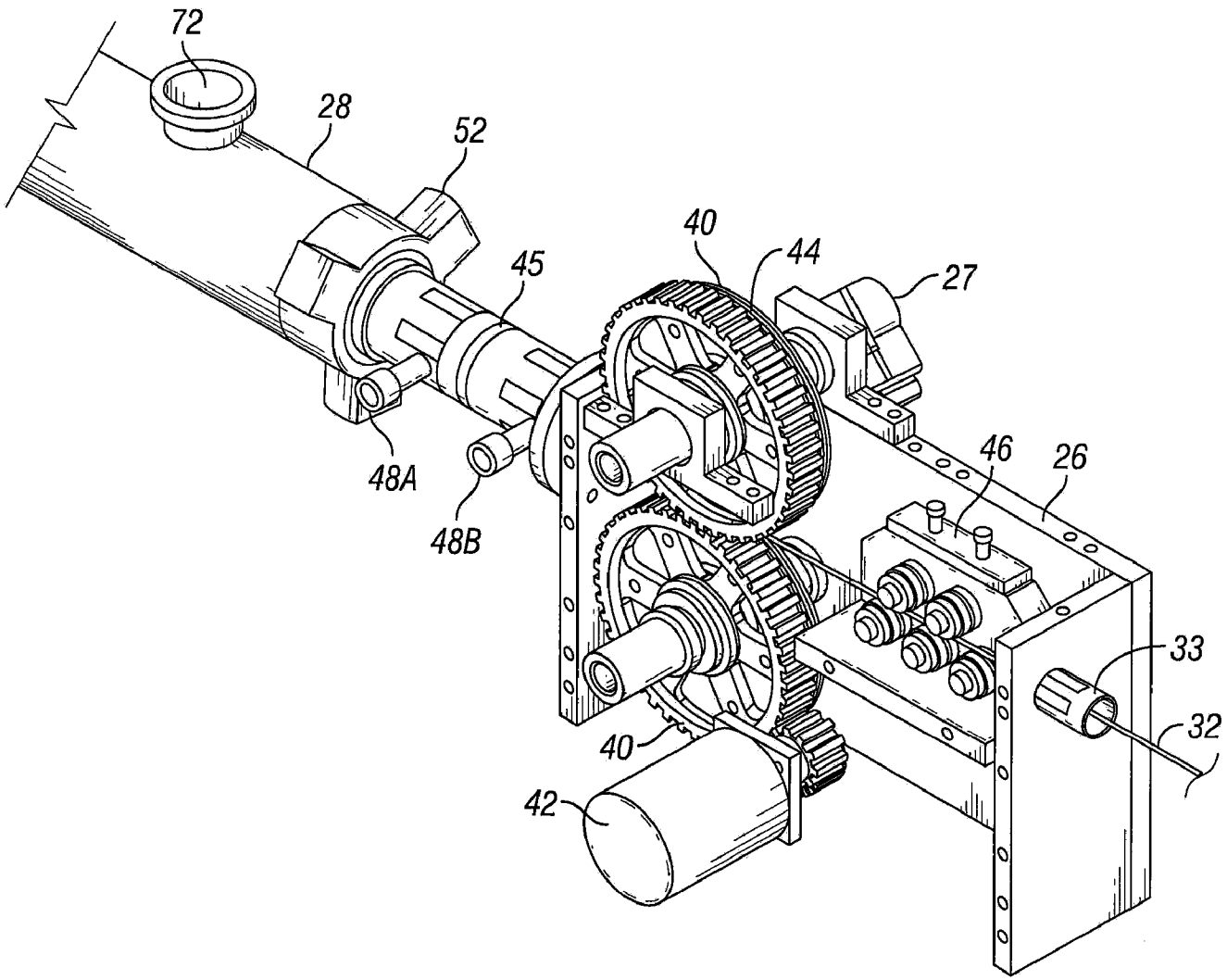
FIG. 2 illustrates an injector according to an exemplary embodiment of the present invention.

FIG. 2 illustrates injector 26 according to an exemplary embodiment of the present invention and is used to drive tubewire 32 at a selected speed. Referencing FIGS. 1A/B and 2, to begin an exemplary method of the present invention, tubewire 32 is fed into injector 26 from spool 34. If spool 34 is electrically or mechanically driven, spool 34 will assist in unspooling tubewire 34. However, in the alternative, injector 26 may pull tubewire 32 from spool 34 without the assistance of spool 34.

In this exemplary embodiment, injector 26 has a drive mechanism which includes a multi-wheel injector, having two or more wheels 40 being driven by a gear (attached to wheels 40) and motor 42. Injector 26 applies a pushing force to tubewire 32 in order to inject it into coiled tubing 22, while also being adapted to apply a pulling force to tubewire 32 in order to retrieve it from tubing 22. Upper and lower wheels 40 are assembled in sets of two such that tubewire 32 passes between each set of two wheels 40. Wheels 40 each have a groove 44 around the outer edge which encloses most of tubewire 32 as it moves between wheels 40, thereby applying a contact friction force against tubewire 32. Grooves 44 are designed to impart the maximum amount of friction without damaging tubewire 32 or causing tubewire 32 to become oval. Although the drive mechanism of injector 26 is described as a multi-wheel design, those ordinarily skilled in the art having the benefit of this disclosure realize other injectors may be utilized, such as, for example, skates/gripper blocks and chains in various forms, or drive belts and/or wheels in various forms.

Referring to FIGS. 1A/B and 2, a specially designed pack-off 45 is coupled between injector 26 and T-connection 28. Pack-off 45 includes ports 48*a,b* which provide hydraulic control pressure to energize and de-energize pack-off 45. A hammer-union connection 52, also as known in the art, is used to connect T-connection 28 to pack-off 45. Pack-off 45 provides a seal around tubewire 32 necessary to contain the pressure created by the pumping of the fluid through coiled tubing 22. Pack-off 45 is also designed to allow a small amount of fluid to drip out to lubricate tubewire 32 as it enters pack-off 45. Moreover, injector 26 is designed to generate forces to overcome the pressure in coiled tubing 22 and the frictional drag of tubewire 32 at it passes through pack-off 45, and may even be used to pull tubewire 32 of spool 34 if a powered spool 34 is not being used.

An exemplary embodiment of the present invention includes a bending/straightening apparatus 46 which helps minimize the sliding friction of tubewire 32 as it moves through coil 22 by conditioning tubewire 32 to a set curvature or straightness as needed. In the exemplary embodiment of FIG. 2, the bending/straightening apparatus 46 straightens or bends tubewire 32 to a selected degree such that the residual curvature of tubewire 32 matches the curve of coiled tubing 22 on reel 24 as closely as possible. Moreover, tubewire 32 may be injected after is has been perfectly straightened by apparatus 46 or some other means, or alternatively, bent to some curve other than the curve of coiled tubing 22 on reel 24. Although disclosed as a multi-wheeled design, those ordinarily skilled in the art having the benefit of this disclosure understand there are a variety of apparatuses which may be used for this purpose and there are a variety of curvatures which may be utilized depending on the job parameters.

In an alternative embodiment, the natural curvature of tubewire 32 is in the same direction as the curvature of coiled tubing 22. In one embodiment, for example, bending or straightening of tubewire 32 may be accomplished by unspooling tubewire 32 from the bottom of spool 34 while the whip end of coiled tubing 22 is located at the bottom of reel 24, so that the residual curvature is naturally in the same direction as the curve of coiled tubing 22 on reel 24. Here, tubewire 32 is spooled off spool 34 in a clockwise direction and injected into coiled tubing 22 on reel 24 in a clockwise direction, as illustrated in FIG. 1A. Accordingly, as tubewire 32 is un-spooled from the bottom of spool 34, it has a natural curvature in the same direction as the curvature of coiled tubing 22 on reel 24. However, in the alternative, tubewire 32 and coiled tubing 22 may be wrapped in the opposite direction such that the whip end of coil tubing 22 is located at the top of reel 24, while tubewire 32 un-spools from the top of spool 34; therefore, tubewire 32 unspools off spool 34 in a counter clockwise direction and is injected into coiled tubing 22 in a counter clockwise direction so that, again, the natural curvature of tubewire 32 is in the same direction as the curvature of coiled tubing 22 on reel 24.

In yet another exemplary embodiment, the injection and retrieval of tubewire 32 may be aided by placing coiled tubing 22 onto a large diameter reel, thus providing a larger curvature than would be found on most working or yard coiled tubing reels. The larger coiled tubing curvature will assist in reducing the sliding friction of tubewire 32 against coiled tubing 22 and, therefore, would reduce the fluid velocities required and, in turn, reduce the input pressure or allowing a longer string of tubewire to be injected.

In yet another exemplary embodiment, spool 34 may be large enough in diameter such that as tubewire 32 spools off and goes through injector 26, it already has a residual curvature to match, or to match as closely as possible, the curvature of the coiled tubing 22 on reel 24. In this exemplary embodiment, bending/straightening apparatus 46 would not be needed.

Figure 3:
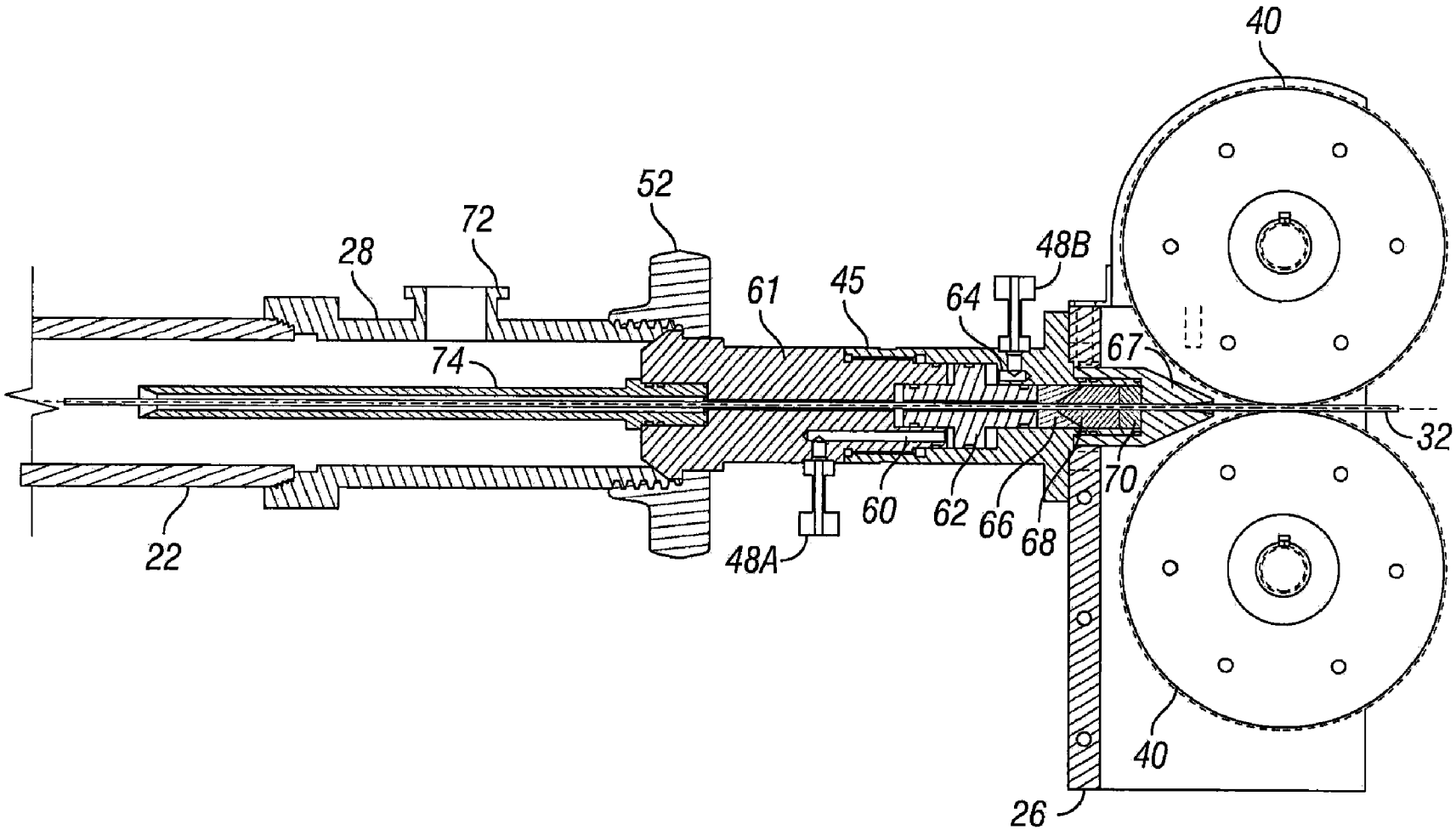
FIG. 3 is a section view of a packoff according to an exemplary embodiment of the present invention.

FIG. 3 illustrates a sectional view of pack-off 45 according to an exemplary embodiment of the present invention. In order to energize pack-off 45 to seal around tubewire 32, pressure is pumped into port 48*a* and through fluid passage 60 located along piston housing 61, where it pressures up on seal piston 62. Once pressure is applied, the fluid on the side of seal piston 62 opposite passage 60 would then be forced out of the piston cavity via fluid passage 64 and port 48*b*. In response to the pressure applied to port 48*a*, piston 62 is driven toward cone 66, which has a flat side and a tapered side, as shown. A seal 68 is adjacent cone 66, located in cone housing 67, and also has a tapered end to mate with the tapered end of cone 66. As such, cone 66 forces seal 68 tightly against tubewire 32 once pressure is applied. A seal back up ring 70 is located adjacent seal 68 to prevent seal 68 from extruding out around the gap between seal 70 and tubewire 32. Back up ring 70 has an inner diameter of sufficient size to fit tightly around tubewire 32.

Pressure may be applied via port 48*a* until seal 68 is tight enough where fluid is not allowed to leak on the side of seal 68 facing injector 26. Seal 68 has properties which allows it to seal, while still allowing tubewire 32 to pass through it without damage, as known in the art. In order to de-energize seal 68, pressure is pumped into 48*b* and out of 48*a* in order to reverse the energizing procedure. In an alternative exemplary embodiment of the present invention, pack-off 45 is selectively pressured to provide a seal around tubewire 32 while allowing still fluid to drip, thereby providing lubrication of the tubewire 32, as would be understood by those ordinarily skilled in the art having the benefit of this disclosure. In the alternative, however, seal 68 may completely seal around tubewire 32 and the lubrication can be applied by some external means.

Further referring to the exemplary embodiment of FIG. 3, a T-connection 28 is coupled to pack-off 45 via hammer union connection 52. T-connection 28 has a treating iron port 72, which is coupled to treating iron 50*a* for fluid communication. The whip end of coiled tubing 22 is attached to the other side of T-connection 28, as understood in the art. Treating iron port 72 is used to connect the treating iron 50*a* which, in turn, connects to pump 30 in order to provide the high velocity fluid to and from coiled tubing 22. The construction and operation of treating irons is known in the art. As illustrated in FIGS. 1A/B, treating irons 50*a,b* are connected to the whip and core ends of coiled tubing 22, thereby allowing bi-directional fluid flow through coiled tubing 22. The pumped fluid may be recirculated through coil 22 and pump 30 via treating iron 50, reused or discarded.

Referring to the exemplary embodiment of FIG. 3, pack-off 45 also includes a wand 74 attached to its end opposite the injector 26. Wand 74 extends through T-connection 28 and into the whip end of coiled tubing 22. Flexible wand 74 is used to support tubewire 32 as it transitions from the coiled tubing wall to the centerline of the pack-off 45, which prevents tubewire 32 from buckling. In a preferred embodiment, wand 74 is a flexible tube which may be comprised of a number of materials, such as metal or plastic. If, during injection, tubewire 32 should stop for some reason while injector 26 continues to inject, tubewire 32 will begin to spiral tight against the coiled tubing wall, which could result in tubewire 32 bending or buckling. However, as the spiral nears the pack-off 45, wand 74 allows tubewire 32 to enter pack-off 45 gradually, starting from near the coiled tubing wall and then going to the centerline of pack-off 45. If the flexible wand 74 did not exist, or if wand 74 was rigid, tubewire 32 would be forced to bend sharply in order to enter pack-off 45.

During experimentation for the present invention, it was discovered the tubewire may bend at very low injection forces. Therefore, the flexible wand 74 is required to support tubewire 32 as it transitions from the coiled tubing wall to the centerline of the pack-off 45, thus preventing buckling. The injection process is, of course, controlled by control system 36 which shuts down injector 26 in this event; however, injector 26 may not act fast enough. As the injection forces get higher (for example with higher coiled tubing injection pressures), especially in larger coiled tubing where the tubewire 32 is even more susceptible to buckling, this flexible wand becomes critical.

Now that an exemplary embodiment of system 20 has been described, an exemplary method of the present invention will now be described. With reference to FIGS. 1 and 2, to begin the injection process, tubewire 32 is unspooled from spool 34 and into injector 26 via opening 33. As previously discussed, tubewire 32 may be passed through bending/straightening apparatus 46 in order to straighten or bend tubewire 32 to some desired curvature. Tubewire 32 is then passed between upper and lower wheels 40 via grooves 44, where contact friction is applied in order to create a pushing force to inject tubewire 32 into coiled tubing 22.

Thereafter, tubewire 32 is passed through pack-off 45 and T-connection 28. As tubewire 32 passes through pack-off 45, a small amount of fluid is allowed to drip on tubewire 32 for lubrication, as previously discussed. In the alternative, however, some external means of lubrication can be applied and pack-off 45 completely seals around tubewire 32. Nevertheless, once tubewire 32 has passed through pack-off 45, fluid is pumped by pump 30 at a high rate into the whip end of coiled tubing 22, via port 72, and out of the core end of coiled tubing 22, while the driving mechanism of injector 26 continues to inject tubewire 32 into coiled tubing 22: this producing a fluid drag on tubewire 32 in the direction of the pushing force applied to tubewire 32. Tubewire 32 continues to be injected until a required length of tubewire, preferably a length equivalent to the length of coiled tubing 22, is injected into coiled tubing 22 while the tubing is on reel 24. In an alternative embodiment, extra tubewire 32 would be injected until some extra extends out of the core end of coiled tubing 22 so a permanent pack-off and electrical connection can be done.

Studies have found that coiled tubing tends to grow longer after it has been in the well for a period of time. Accordingly, in an alternative embodiment of the present invention, some excess tubewire 32 may be injected into coiled tubing 22. For example, 0.1-3.0% more tubewire than coil tubing could be injected in order to avoid buckling or tension failure of the tubewire during field operations.

In an exemplary embodiment, after the pack-off and electrical connection are done, pumping is continued until as much tubewire as possible is injected: this places the entire tubewire extrados (i.e., the side of the wrapped coiled tubing inner diameter farthest from the center of reel 24) within the tubing. Pumping is then reversed, and a specific amount of tubewire 32 is retrieved to leave 0.1-3.0%, for example, extra tubewire by length in the coiled tubing. Then, injector 26 is stopped, however, pumping is continued, resulting in the movement of tubewire 32 to the extrados of the coiled tubing 22 near the whip end of the coil and moves it to the intrados (i.e., side of coiled tubing wall closest to center of reel 24) of the coil 22 nearer the core end. However, in the alternative, the extra tubewire may be located at the core end of coiled tubing 22, the middle of coiled tubing 22 or some other point along coiled tubing 22. Those ordinarily skilled in the art having the benefit of this disclosure realize this process may be altered to meet a variety of downhole requirements.

Also, during experimental studies for the present invention, it was discovered that tubewire 32 can not be successfully pushed or pulled mechanically through coil 22 while the coil 22 is on a reel any significant distance without also pumping fluid. It was also discovered a high rate of fluid flow is required to create the fluid drag and turbulence on tubewire 32 necessary to move it through coil tubing 22, and this velocity rate is dependent on a variety of factors, such as, for example, the tubewire size, fluid type and temperature, the roughness of the outside of the tubewire or length of coiled tubing. For example, if water is used, however, along with a ⅛" tubewire, a minimum water velocity of between 1000 ft/min and 1400 ft/min is required to inject the tubewire 32. Due to high pressure drops in the coil at these high fluid velocities, the fluid must be pumped at high pressures (5,000-15,000 psi, for example), thereby necessitating the pack-off 45 previously discussed.

A variety of fluids may be used with the present invention. In an exemplary embodiment, the fluid utilized is water. In order to maximize drag on tubewire 32, minimize the required pump pressures and allow injection into longer strings of coil (e.g., 16,000 foot or longer), the water should be below 30 Celsius. If the water or other fluid is recirculated via treating iron 50*a,b*, a cooler/heat exchanger 43 (FIG. 1B) can be added into the circuit in order to cool the fluid. When the water is cooler than 30 Celsius, the injection fluid velocity in the coil 22 ahead of the tubewire 32 needs to be a minimum of 1000 ft/min. In an alternative embodiment, nitrogen may be added to the water in order to reduce the required pump pressure for the tubewire injection. During testing, these pressures were reduced by about 20%. Those ordinarily skilled in the art having the benefit of this disclosure realize there are a variety of software applications which may be utilized to determine the necessary fluids velocities and pressures, such as, for example, the CIRCA™ Software, developed by BJ Services Company of Houston, Tex., or some other comparable software platform.

CIRCA has the ability to model the average insitu velocities in coiled tubing of both the liquid and the gas of a two phase liquid/gas mixture. It has been determined through modeling and testing that a minimum insitu water velocity is required for injection to proceed smoothly. The minimum appears to be the same as the minimum required in open pipe ahead of the tubewire using just water; namely, 1000 ft/min. For a given amount of liquid rate (water in our tests), a gas is added (nitrogen in our case) until the minimum insitu liquid velocity is achieved. The gas and liquid rates which are required would be modeled ahead of time and, if chosen properly, provide a reduction in pumping pressure over the use of liquid alone. Please note that any gas could potentially be used; air, carbon dioxide, or nitrogen, for example.

However, in the alternative, other fluids having a metal to metal friction reduction property may be utilized to lower the fiction sliding force between tubewire 32 and coil 22, as well as fluids with fluid fiction reducing additives to lower the pumping pressure or fluids having a combination of these attributes. Those ordinarily skilled in the art having the benefit of this disclosure realize a variety of fluids may be utilized for this purpose.

During the exemplary injection process described above, control system 36 continues to monitor the injector force data received from pump 30, injector 26 and spool 34. Based upon data received from the coiled tubing pumping/force models developed using modeling software, such as CIRCA™ discussed above, control system 36 regulates each of these components to ensure the optimal injector force levels are maintained throughout the process. Those ordinarily skilled in the art having the benefit of this disclosure realize there are a number of ways to design such a control system.

Now that tubewire 32 has been injected, we will now describe an exemplary method by which tubewire 32 may be retrieved from coil 22. However, before tubewire 32 is retrieved, a section of tubing 22 is cut off leaving tubewire 32 sticking out the end of coiled tubing 22. Then, a new weld-on fitting may be welded onto the coil 22 or some other alternate fitting attached to coil 22 and T-connection 28 is attached. Injector 26 is then brought over to tubewire 32, and tubewire 32 is pushed through pack-off 45, while it is de-energized, until it contacts the drive wheels 40 of injector 26. Drive wheels 40 are then slowly rotated, causing drive wheels 40 to grip tubewire 32, and to pull it through the wheels 40. At the same time, injector 26 is pushed towards coil tubing 22 and T-connection 28 until contact is made, at which point injector 26 is stopped. The pumping equipment is then rigged and attached, if not already done so.

An exemplary embodiment of the retrieving process of the present invention will now be described. In order to retrieve tubewire 32, first, the fluid flow direction is reversed such that fluid is pumped by pump 30 into the core end of coiled tubing 22 and out of the whip end via treating iron 50. The injector 26 then begins to pull on tubwire 32 in order to retrieve it from coiled tubing 22 as the fluid is pumped, as discussed previously (however, here the process is reversed). As discussed previously, the reversed fluid flow provides fluid drag on tubewire 32 in the direction of the pulling force.

In an alternative retrievable embodiment, slack may be pumped into the tubewire before injector 26 begins retrieval. Here, pump 30 begins pumping into the core end of coiled tubing 22 and continues pumping in order to put tubewire 32 into proper position within coiled tubing 22 for retrieval: this is known as "pumping slack into the tubewire." Here, slack is pumped into tubewire 32 in order to move tubewire 32 off the wall of coiled tubing 22, and more into the center, high fluid velocity flow area of coil tubing 22. The time period for the initial pumping may be affected by a number of factors, such as, for example, tubewire length, coiled tubing length or fluid type, as would be understood by those of skill in the art having the benefit of this disclosure. These and other factors may be inputted into modeling software, such as CIRCA™ discussed above, in order to determine the job parameters, as known in the art. In a further alternative embodiment, instead of pumping slack into tubewire 32, pump 30 may be started and stopped in order to vibrate tubewire 32 into proper position off the wall of coil 22. After the slack has been pumped, retrieval may begin as previously mentioned. Moreover, tubewire 32 or coiled tubing 22 may be vibrated during injection or retrieval in order to assist in reducing the friction.

As previously mentioned, control system 36 is used to control various injector forces on system 20 during the injection and retrieval process through a feedback loop provided via links 38. Fluid rates during retrieval are equivalent to those required during injection. In the current embodiment discussed, if a minimum fluid velocity of 1000 fpm is maintained, then retrieval can occur smoothly. Those ordinarily skilled in the art having the benefit of this disclosure realize a variety of fluid velocities can be utilized dependent upon system conditions.

Moreover, control system 36 controls the interaction between spooler 34 and injector 26 during both injection and retrieval. The speed of spooler 34 and injector 26 must be coordinated such that tension remains in the portion of tubewire 32 between spool 34 and injector 26. Tension is needed to ensure tubewire 32 is wrapped tightly onto spool 34. If there is not enough tension, loose wraps develop, which then fold over as more wraps are placed on top, potentially leading to damage of tubewire 32. The tension is set hydraulically in such a way that spooler 34 tries to go a little faster than injector 26 and, therefore, pulls a bit on tubewire 32. The speed is controlled by an operator, who makes adjustments at a control station. However, in the alternative, a control system may be used here also. Nevertheless, the operator, or control system, can adjust from zero speed to a specified maximum either for injection or retrieval, and the hydraulics then maintain everything at that speed. Those ordinarily skilled in the art having the benefit of this disclosure realize this and other methods of controlling spooler tension may be utilized.

Once slack has been pumped into tubewire 32, fluid continues to be pumped while, simultaneously, the driving mechanism of injector 26 is run backwards such that wheels 40 pull tubewire 32 from coil 22, while at the same time controlling the speed of the pulling process. During the retrieval process, control system 36 continues to monitor the injector forces, as previously discussed, in order to maintain the optimal levels required for retrieval. The movement of tubewire 32 within coil tubing 22 is facilitated by the high fluid velocities created by pump 30, as described for the injection procedure above. During the retrieval process, spool 34 may be driven in order to spool tubewire 32 neatly onto spool 34.

Figure 4:
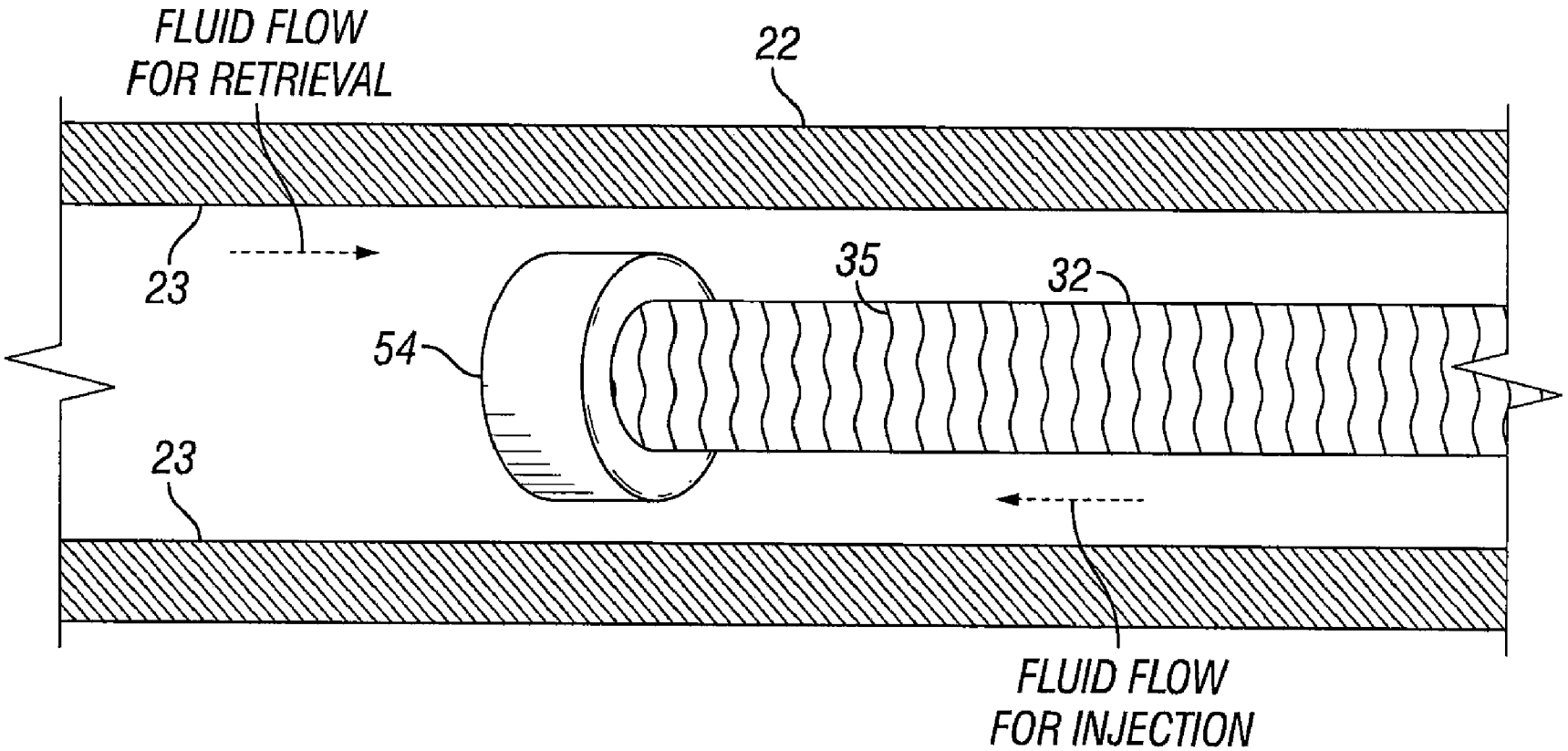
FIG. 4 illustrates a protuberance attached to the tubewire according to an exemplary embedment of the present invention.

Further referring to the exemplary embodiment of FIG. 4, a nubbin or protuberance 54 may be attached to the free end of tubewire 32 to aid in the retrieval or injection processes. Protuberance 54 may have diameter up to the inner diameter of coil 22, as long as some provision is made to allow fluid to pass by or through protuberance 54. In a preferred embodiment, protuberance 54 is a Swagelok™ fitting and cap for a ⅛" tubewire. Protuberance 54 would have to be attached to tubewire 32 after the free end has passed pack-off 45. Protuberance 54 also provides a seal on the end of tubewire 32 in order to prevent fluid from flowing up into tubewire 32, which could result in a loss of power or other electrical issues. Thereafter, hammer-union connection 52 and coiled tubing 22 will be attached to T-connection 28. Those ordinarily skilled in this art having the benefit of this disclosure realize there are a variety of protuberance which may be utilized for this purpose.

Protuberance 54 causes a pressure drop in the fluid near the end of tubewire 32 during pumping, and, thus, imparts a force onto the end of the tubewire 32 which helps force tubewire 32 along the direction of fluid flow indicated in FIG. 4. Most importantly, protuberance 54 helps move tubewire 32 away from the wall 23 of coil 22 during the starting portion (i.e., pumping slack) of the retrieval process, as well as maintaining slack in tubewire 32 during retrieval, thereby reducing the likelihood of tubewire 32 stopping due to the capstan effect created by attempting to retrieve tubewire 32 too quickly. In the most preferred embodiment, protuberance 54 is sized properly so as to prevent a capstan effect from occurring during injection or retrieval. Those ordinarily skilled in the art having the benefit of this disclosure realize there are a variety of ways in which to design protuberance 54 to limit capstan effects.

Also, in another exemplary embodiment, the outer surface 35 of tubewire 32 may be conditioned, roughened or otherwise modified, such as, for example, increasing the outside diameter with plastic or other material which bends easily, to increase the frictional drag forces imparted by the fluid traveling through coiled tubing 22, as illustrated in FIG. 4.

In yet another exemplary embodiment of the present invention, coiled tubing 22 may be removed from reel 24 and stretched out along the ground before the injection and retrieval processes begin. Those ordinarily skilled in the art having the benefit of this disclosure realize there are a variety of ways in which to minimize the sliding friction and injector forces during the injection/retrieval processes.

A further aspect of this invention is that a depth counter and velocity measurement device may be utilized, as illustrated in FIG. 1A. In an exemplary embodiment, depth encoder 27 is attached to the shaft of one of the drive wheels 40 of injector 26, and may be, for example, an optical quadrature encoder as known in the art. Depth encoder 27 would be coupled to control system 36, which provides depth encoder 27 with power and collects data from it. The data signal is then mathematically converted to rpm, direction, distance and liner speed by the control system 36, and used by control system 36 to regulate the system.

A further aspect of this invention is that a level wind and tubewire laying control method is preferred to be installed onto spooler 34 to ensure smooth spooling of tubewire 32. Such methods are known in the art.

An exemplary system for injecting or retrieving tubewire into or out of coiled tubing may comprise a system for injecting or retrieving tubewire into or out of coiled tubing, the system comprising: an injector having a drive mechanism adapted to apply a pushing force to the tubewire in order to inject the tubewire, the drive mechanism being further adapted to apply a pulling force on the tubewire in order to retrieve the tubewire; coiled tubing coupled to the injector; and a pumping mechanism adapted to pump fluids through the coiled tubing while the force is being applied, the fluids being pumped in a direction of the force being applied to the tubewire by the drive mechanism, thereby providing fluid drag on the tubewire in order to inject or retrieve the tubewire from the coiled tubing. In another exemplary embodiment, the drive mechanism is adapted to drive the tubewire at a selected speed, the system further comprising a tubewire spooler also adapted to drive at a selected speed, thereby allowing the system to maintain tension in the tubewire during injection or retrieval of the tubewire.

In yet a further exemplary embodiment, the system further comprises a control system to regulate injector forces in order to maintain the injector forces at levels which are necessary for injection or retrieval of the tubewire, the injector forces comprising at least one of a spool speed, drive mechanism speed, drive mechanism force, fluid velocity or fluid pressure. The system may also comprise an apparatus to straighten or bend the tubewire to a selected degree. The fluid utilized may be a two-phase fluid and/or may comprise a friction reducing agent. In yet a further exemplary embodiment, the system may comprise a protuberance attached to a free end of the tubewire, the protuberance being adapted to apply a force on the tubewire in a direction of fluid flow through the coiled tubing. In another embodiment, the coiled tubing is wrapped on a reel.

In yet another exemplary embodiment, the system further comprises a packoff between the injector and coiled tubing, the packoff being adapted to selectively seal around the tubewire while allowing fluid to lubricate the tubewire as the tubewire moves through the packoff. In another embodiment, the drive mechanism comprises: a plurality of wheels adapted to allow the tubewire to pass between the plurality of wheels; and a groove being located around an edge of the plurality of wheels, the grooves being adapted to mate with the tubewire such that contact friction is applied to the tubewire, thereby allowing the drive mechanism to apply the pushing or pulling force in order to inject or retrieve the tubewire. In yet another exemplary embodiment, the system further comprises a wand to assist the tubewire as the tubewire transitions between the injector and coiled tubing during injection or retrieval.

An exemplary method of the present invention may provide a method for injecting or retrieving tubewire into or out of coiled tubing, the method comprising the steps of: inserting the tubewire into an injector having a drive mechanism adapted to apply a pushing or pulling force to the tubewire, the injector being coupled to the coiled tubing; applying the pushing or pulling force to the tubewire using the drive mechanism; and pumping fluids through the coiled tubing while the pushing or pulling force is being applied, the fluids being pumped in a direction of the force being applied to the tubewire by the drive mechanism, thereby providing fluid drag on the tubewire in order to inject or retrieve the tubewire from the coiled tubing. In another exemplary method, the tubewire inserted into the injector is received from a spool, the force applied to the tubewire is a pushing force injecting the tubewire into a first end of the coiled tubing and the fluids being pumped through the coiled tubing are pumped into the first end of the coiled tubing, thereby resulting in the tubewire being injected into the coiled tubing.

In yet a further exemplary method, the tubewire being inserted into the injector is received from inside the coiled tubing, the force applied to the tubewire is a pulling force retrieving the tubewire out of a first end of the coiled tubing and the fluids being pumped through the coiled tubing are pumped into a second end of the coiled tubing, thereby resulting in the tubewire being retrieved from the coiled tubing. Yet another method comprises the step of pumping fluid into the second end of the coiled tubing such that the tubewire moves off an inner wall of the coiled tubing before the force is applied to the tubewire. The method may further comprise the step of driving the spool and drive mechanism at speeds such that tension is maintained in the tubewire as the tubewire is fed from the spool and through the injector. An exemplary method may further comprise the step of spooling the retrieved tubewire onto a spool, the spool and drive mechanism being driven at speeds such that tension is maintained in the tubewire as the tubewire is feed from the injector to the spool.

Yet another exemplary method may comprise the step of regulating injector forces using a control system in order to maintain the injector forces at levels which are necessary for injection or retrieval of the tubewire, the injector forces comprising at least one of a spool speed, drive mechanism speed, drive mechanism force, fluid velocity or fluid pressure. Yet another method comprises the step of straightening or bending the tubewire to a selected degree before injecting the tubewire into the coiled tubing, thereby minimizing a sliding friction between the coiled tubing and tubewire during injection. Yet another method comprises the step of attaching a protuberance to a free end of the tubewire in order to assist in the injection or retrieval of the tubewire, the protuberance being adapted to apply a force on the tubewire in a direction of fluid flow.

Yet another exemplary method comprises the step of conditioning an outer surface of the tubewire to increase fluid frictional drag forces on the tubewire The injection of the tubewire may also be accomplished while the coiled tubing is wrapped on a reel or while the coiled tubing is stretched out along a surface. The fluid utilized may comprise at least one of a two-phase fluid or a friction reducing fluid.

Yet another exemplary method comprises the step of injecting extra tubewire length than coiled tubing length into the coiled tubing, the extra tubewire length being located at a selected point along the coiled tubing. Yet another method comprises the step of utilizing a wand to support the tubewire as the tubewire transitions between the coiled tubing and injector during retrieval or injection. Yet another exemplary method comprises the step of spooling the tubewire on a spool such that a curvature of the tubewire is in a same direction as a curvature of the coiled tubing on the reel. Another exemplary method comprises the step of vibrating the tubewire or coiled tubing during injection or retrieval.

In another exemplary method, a pack-off is coupled between the injector and coiled tubing, the method further comprising the step of allowing fluid to drip through the pack-off onto the tubewire as the tubewire is being injected, thereby providing lubrication. In yet another exemplary method, the tubewire is received from a spool, the size of the spool being large enough in diameter such at the tubewire already has a residual curvature substantially matching a curvature of the coiled tubing.

Yet another exemplary method of the present invention provides a method for injecting tubewire into coiled tubing, the method comprising the steps of: inserting the tubewire into an injector having a drive mechanism, the tubewire being received from a spool; feeding a portion of the tubewire into a first end of the coiled tubing using the drive mechanism, the injector being coupled to the first end of the coiled tubing; and injecting the tubewire into the coiled tubing, the injection being accomplished by pumping fluid into the first end of the coiled tubing while using the drive mechanism to apply a pushing force on the coiled tubing mechanism, the pumping providing fluid drag on the tubewire in the direction of the pushing force in order to inject the tubewire into the coiled tubing.

Yet another method comprises the step of feeding the tubewire through a packoff located between the injector and first end of the coiled tubing, the packoff being adapted to selectively seal around the tubewire such that the fluid is allowed to lubricate the tubewire as the tubewire moves through the packoff. Another exemplary method may further comprise the step of utilizing a flexible wand to support the tubewire as it transitions into the coiled tubing during injection.

Yet another exemplary method of the present invention provides a method for retrieving tubewire out of coiled tubing, the method comprising the steps of: inserting the tubewire into an injector having a drive mechanism, the injector being attached to the a first end of the coiled tubing; pumping fluid into a second end of the coiled tubing while applying a pulling force to the tubewire using the drive mechanism, thereby providing fluid drag on the tubewire in the direction of the pulling force in order to retrieve the tubewire from the coiled tubing. After inserting the tubewire and before pumping fluid, the method further comprises the step of pumping fluid into the second end of the coiled tubing such that the tubewire moves off an inner wall of the coiled tubing, thereby producing slack in the tubewire. Yet another exemplary method comprises the steps of: spooling the tubewire onto a spool as the tubewire is being pulled from the coiled tubing; and driving the spool and drive mechanism at speeds such that tension is maintained in the tubewire.

Although various embodiments have been shown and described, the invention is not so limited and will be understood to include all such modifications and variations as would be apparent to one skilled in the art. For example, other things may be injected/retrieved such as, for example, solid wires, fiber optic cable bundles or singular cables, plastic coated wires or coated memory wire. Also, for example, the present invention may also be employed by coupling the injector to the core end of the coiled tubing instead of the whip end. As such, those ordinarily skilled in the art having the benefit of this disclosure realize the injection/retrieval process described herein may be employed in a number of ways. Accordingly, the invention is not to be restricted except in light of the attached claims and their equivalents.

What is claimed is:

1. A system for injecting or retrieving tubewire into or out of coiled tubing, the system comprising:

a non-pressurized injector having a drive mechanism adapted to apply a pushing force to the tubewire as the tubewire moves through the non-pressurized injector, the drive mechanism being further adapted to apply a pulling force on the tubewire as the tubewire moves through the non-pressurized injector;

coiled tubing coupled to the non-pressurized injector; and a pumping mechanism adapted to pump fluids through the coiled tubing while the force is being applied, the fluids being pumped in a direction of the force being applied to the tubewire by the drive mechanism, thereby providing fluid drag on the tubewire in order to inject or retrieve the tubewire from the coiled tubing.

2. A system as defined in claim 1, wherein the drive mechanism is adapted to drive the tubewire at a selected speed, the system further comprising a tubewire spooler also adapted to drive at a selected speed, thereby allowing the system to maintain tension in the tubewire during injection or retrieval of the tubewire.

3. A system as defined in claim 1, the system further comprising a control system to regulate injector forces in order to maintain the injector forces at levels which are necessary for injection or retrieval of the tubewire, the injector forces comprising at least one of a spool speed, drive mechanism speed, drive mechanism force, fluid velocity or fluid pressure.

4. A system as defined in claim 1, the system further comprising an apparatus to straighten or bend the tubewire to a selected degree.

5. A system as defined in claim 1, wherein the fluid is a two-phase fluid.

6. A system as defined in claim 1, wherein the fluid comprises a friction reducing agent.

7. A system as defined in claim 1, the system further comprising a protuberance attached to a free end of the tubewire, the protuberance being adapted to apply a force on the tubewire in a direction of fluid flow through the coiled tubing.

8. A system as defined in claim 1, wherein the coiled tubing is wrapped on a reel.

9. A system as defined in claim 1, the system further comprising a packoff between the non-pressurized injector and coiled tubing, the packoff being adapted to selectively seal around the tubewire while allowing fluid to lubricate the tubewire as the tubewire moves through the packoff.

10. A system as defined in claim 1, wherein the drive mechanism comprises:

a plurality of wheels adapted to allow the tubewire to pass between the plurality of wheels; and a groove being located around an edge of the plurality of wheels, the grooves being adapted to mate with the tubewire such that contact friction is applied to the tubewire, thereby allowing the drive mechanism to apply the pushing or pulling force in order to inject or retrieve the tubewire.

11. A system as defined in claim 1, the system further comprising a wand to assist the tubewire as the tubewire transitions between the non-pressurized injector and coiled tubing during injection or retrieval.

12. A method for injecting or retrieving tubewire into or out of coiled tubing, the method comprising the steps of:

(a) inserting the tubewire into a non-pressurized injector having a drive mechanism adapted to apply a pushing or pulling force to the tubewire, the non-pressurized injector being coupled to the coiled tubing;

(b) applying the pushing or pulling force to the tubewire using the drive mechanism; and (c) pumping fluids through the coiled tubing while the pushing or pulling force is being applied, the fluids being pumped in a direction of the force being applied to the tubewire by the drive mechanism, thereby providing fluid drag on the tubewire in order to inject or retrieve the tubewire from the coiled tubing.

13. A method as defined in claim 12, wherein the tubewire being inserted into the non-pressurized injector in step (a) is received from a spool, the force applied to the tubewire in step (b) is a pushing force injecting the tubewire into a first end of the coiled tubing and the fluids being pumped through the coiled tubing in step (c) are pumped into the first end of the coiled tubing, thereby resulting in the tubewire being injected into the coiled tubing.

14. A method as defined in claim 13, the method further comprising the step of driving the spool and drive mechanism at speeds such that tension is maintained in the tubewire as the tubewire is fed from the spool and through the non-pressurized injector.

15. A method as defined in claim 13, the method further comprising the step of straightening or bending the tubewire to a selected degree before injecting the tubewire into the coiled tubing, thereby minimizing a sliding friction between the coiled tubing and tubewire during injection.

16. A method as defined in claim 13, wherein a pack-off is coupled between the non-pressurized injector and coiled tubing, the method further comprising the step of allowing fluid to drip through the pack-off onto the tubewire as the tubewire is being injected, thereby providing lubrication.

17. A method as defined in claim 12, wherein the tubewire being inserted into the non-pressurized injector in step (a) is received from inside the coiled tubing, the force applied to the tubewire in step (b) is a pulling force retrieving the tubewire out of a first end of the coiled tubing and the fluids being pumped through the coiled tubing in step (c) are pumped into a second end of the coiled tubing, thereby resulting in the tubewire being retrieved from the coiled tubing.

18. A method as defined in claim 17, the method further comprising the step of pumping fluid into the second end of the coiled tubing such that the tubewire moves off an inner wall of the coiled tubing before the force is applied to the tubewire.

19. A method as defined in claim 17, the method further comprising the step of spooling the retrieved tubewire onto a spool, the spool and drive mechanism being driven at speeds such that tension is maintained in the tubewire as the tubewire is feed from the non-pressurized injector to the spool.

20. A method as defined in claim 12, the method further comprising the step of regulating injector forces using a control system in order to maintain the injector forces at levels which are necessary for injection or retrieval of the tubewire, the injector forces comprising at least one of a spool speed, drive mechanism speed, drive mechanism force, fluid velocity or fluid pressure.

21. A method as defined in claim 12, the method further comprising the step of attaching a protuberance to a free end of the tubewire in order to assist in the injection or retrieval of the tubewire, the protuberance being adapted to apply a force on the tubewire in a direction of fluid flow.

22. A method as defined in claim 12, the method further comprising the step of conditioning an outer surface of the tubewire to increase fluid frictional drag forces on the tubewire.

23. A method as defined in claim 12, wherein the injection of the tubewire is accomplished while the coiled tubing is wrapped on a reel.

24. A method as defined in claim 23, the method further comprising the step of spooling the tubewire on a spool such that a curvature of the tubewire is in a same direction as a curvature of the coiled tubing on the reel.

25. A method as defined in claim 12, wherein the injection of the tubewire is accomplished while the coiled tubing is stretched out along a surface.

26. A method as defined in claim 12, wherein step (c) comprises at least one of a two-phase fluid or a friction reducing fluid.

27. A method as defined in claim 12, the method further comprising the step of injecting more tubewire length than coiled tubing length into the coiled tubing, the extra tubewire length being located at a selected point along the coiled tubing.

28. A method as defined in claim 12, the method further comprising the step of utilizing a wand to support the tubewire as the tubewire transitions between the coiled tubing and non-pressurized injector during retrieval or injection.

29. A method as defined in claim 12, the method further comprising the step of vibrating the tubewire or coiled tubing during injection or retrieval.

30. A method as defined in claim 12, wherein the tubewire is received from a spool, the size of the spool being large enough in diameter such at the tubewire already has a residual curvature substantially matching a curvature of the coiled tubing.

31. A method as defined in claim 12, the method further comprising the step of pumping the fluids to move the tubewire located near a whip end of the coiled tubing to an extrados of the coiled tubing, and to move the tubewire located near a core end of the coiled tubing to an intrados of the coiled tubing.

32. A method for injecting tubewire into coiled tubing, the method comprising the steps of:

(a) inserting the tubewire into a non-pressurized injector having a drive mechanism, the tubewire being received from a spool;

(b) feeding a portion of the tubewire into a first end of the coiled tubing using the drive mechanism, the non-pressurized injector being coupled to the first end of the coiled tubing; and (c) injecting the tubewire into the coiled tubing, the injection being accomplished by pumping fluid into the first end of the coiled tubing while using the drive mechanism to apply a pushing force on the coiled tubing mechanism, the pumping providing fluid drag on the tubewire in the direction of the pushing force in order to inject the tubewire into the coiled tubing.

33. A method as defined in claim 32, wherein step (b) comprises the step of feeding the tubewire through a packoff located between the non-pressurized injector and first end of the coiled tubing, the packoff being adapted to selectively seal around the tubewire such that the fluid is allowed to lubricate the tubewire as the tubewire moves through the packoff.

34. A method as defined in claim 32, wherein step (a) further comprises the step of straightening or bending the tubewire to a selected degree before injecting the tubewire into the coiled tubing, thereby minimizing a sliding friction between the coiled tubing and tubewire during injection.

35. A method as defined in claim 32, wherein step (a) further comprises the step of attaching a protuberance to a free end of the tubewire in order to assist in the injection of the tubewire, the protuberance being adapted to apply a force on the tubewire in a direction of fluid flow.

36. A method as defined in claim 32, wherein the injection of the tubewire is accomplished while the coiled tubing is wrapped on a reel.

37. A method as defined in claim 32, wherein the step of pumping fluid comprises at least one of pumping a two-phase fluid or a friction reducing fluid.

38. A method as defined in claim 32 the method further comprising the step of injecting more length of tubewire than coiled tubing into the coiled tubing.

39. A method as defined in claim 32, the method further comprising the step of utilizing a flexible wand to support the tubewire as it transitions into the coiled tubing during injection.

40. A method for retrieving tubewire out of coiled tubing, the method comprising the steps of:

(a) inserting the tubewire into a non-pressurized injector having a drive mechanism, the non-pressurized injector being attached to the a first end of the coiled tubing;

(b) pumping fluid into a second end of the coiled tubing while applying a pulling force to the tubewire using the drive mechanism, thereby providing fluid drag on the tubewire in the direction of the pulling force in order to retrieve the tubewire from the coiled tubing.

41. A method as defined in claim 40, wherein after step (a) and before step (b), the method further comprises the step of pumping fluid into the second end of the coiled tubing such that the tubewire moves off an inner wall of the coiled tubing, thereby producing slack in the tubewire.

42. A method as defined in claim 40, the method further comprising the steps of:

spooling the tubewire onto a spool as the tubewire is being pulled from the coiled tubing; and driving the spool and drive mechanism at speeds such that tension is maintained in the tubewire.

43. A method as defined in claim 40, wherein step (a) further comprises the step of attaching a protuberance to a free end of the tubewire in order to assist in the retrieval of the tubewire, the protuberance being adapted to apply a force on the tubewire in a direction of fluid flow.

44. A method as defined in claim 40, wherein the retrieval of the tubewire is accomplished while the coiled tubing is wrapped on a reel.

45. A method as defined in claim 40, wherein the steps of pumping fluid comprise pumping at least one of a two-phase fluid or a friction reducing fluid.

46. A method as defined in claim 40, the method further comprising the step of utilizing a flexible wand to support the tubewire as it transitions out of the coiled tubing during retrieval.

47. A system for injecting or retrieving tubewire into or out of coiled tubing, the system comprising:

an injector having a drive mechanism adapted to apply a pushing force to the tubewire in order to inject the tubewire, the drive mechanism being further adapted to apply a pulling force on the tubewire in order to retrieve the tubewire;

coiled tubing coupled to the injector;

a pumping mechanism adapted to pump fluids through the coiled tubing while the force is being applied, the fluids being pumped in a direction of the force being applied to the tubewire by the drive mechanism, thereby providing fluid drag on the tubewire in order to inject or retrieve the tubewire from the coiled tubing; and a protuberance attached to a free end of the tubewire, the protuberance being adapted to apply a force on the tubewire in a direction of fluid flow through the coiled tubing.

48. A method for injecting or retrieving tubewire into or out of coiled tubing, the method comprising the steps of:

(a) inserting the tubewire into an injector having a drive mechanism adapted to apply a pushing or pulling force to the tubewire, the injector being coupled to the coiled tubing;

(b) applying the pushing or pulling force to the tubewire using the drive mechanism; and (c) pumping fluids through the coiled tubing while the pushing or pulling force is being applied, the fluids being pumped in a direction of the force being applied to the tubewire by the drive mechanism, thereby providing fluid drag on the tubewire in order to inject or retrieve the tubewire from the coiled tubing, wherein step (a) further comprises the step of attaching a protuberance to a free end of the tubewire in order to assist in the retrieval of the tubewire, the protuberance being adapted to apply a force on the tubewire in a direction of fluid flow.

* * * * *